US005553783A

United States Patent [19]

Slavas et al.

[11] Patent Number: 5,553,783

[45] Date of Patent: Sep. 10, 1996

[54] FLAT FAN SPRAY NOZZLE

[75] Inventors: James Slavas, Wendell; Matthew Betsold, Northfield; Douglas Dziadzio, Montague; Robert Bedaw, Sr., Turners Falls, all of Mass.; Vernon Bernard, Winchester, N.H.

[73] Assignee: Bete Fog Nozzle, Inc., Greenfield, Mass.

[21] Appl. No.: 370,096

[22] Filed: Jan. 9, 1995

[51] Int. Cl.[6] ..... B05B 7/04

[52] U.S. Cl. ..... 239/403; 239/432

[58] Field of Search ..... 239/432, 561, 239/548, 552, 553, 403, 296, 601, 602, DIG. 1

[56] References Cited

U.S. PATENT DOCUMENTS

| | | | |
|---|---|---|---|
| 1,059,611 | 4/1913 | Jordan . | |
| 1,140,655 | 5/1915 | Bell . | |
| 1,450,881 | 4/1923 | Allen . | |
| 1,485,495 | 3/1924 | Eldred et al. . | |
| 2,252,320 | 8/1941 | Hughey | 158/27.4 |
| 2,746,792 | 5/1956 | Hough | 299/18 |
| 3,306,540 | 2/1967 | Reichert | 239/432 X |
| 3,519,259 | 7/1970 | Death et al. | 266/34 |
| 3,606,154 | 9/1971 | Tufts | 239/8 |
| 3,741,482 | 6/1973 | Eliason et al. | 239/29.6 |
| 3,784,111 | 1/1974 | Piggott | 239/427.3 |
| 3,913,845 | 10/1975 | Tsuji | 239/556 |
| 4,014,470 | 3/1977 | Burnham | 239/472 |
| 4,284,239 | 8/1981 | Ikeuchi | 239/8 |
| 4,330,086 | 5/1982 | Nysted | 239/8 |
| 4,343,434 | 8/1982 | Haruch | 239/390 |
| 4,456,181 | 6/1984 | Burnham | 239/403 |
| 4,592,510 | 6/1986 | Grothe | 239/432 |
| 4,765,540 | 8/1988 | Yie | 239/432 X |
| 4,972,995 | 11/1990 | Shara et al. | 239/432 X |
| 4,989,788 | 2/1991 | Bendig et al. | 239/429 |
| 5,014,790 | 5/1991 | Papavergos | 239/432 X |
| 5,176,325 | 1/1993 | Vidisck | 239/432 X |
| 5,240,183 | 8/1993 | Bedaw et al. | 239/403 |
| 5,289,976 | 3/1994 | Don et al. | 239/432 X |

FOREIGN PATENT DOCUMENTS

| | | | |
|---|---|---|---|
| 62-186112 | 8/1987 | Japan | 239/432 |

*Primary Examiner*—Kevin P. Weldon

*Attorney, Agent, or Firm*—McCormick, Paulding & Huber

[57] ABSTRACT

An improved spray head for a nozzle for atomizing a liquid with a gas has an open inner end to receive the gas and liquid, a cylindrical medial portion defining a mixing chamber for creating a liquid-gas mixture, and an outer end wall that has a plurality of orifices arranged in a spaced circular orientation about the longitudinal axis of the mixing chamber. Each orifice defines a flow axis which is directed toward a linear target located a predetermined distance from the spray head for atomizing and directing a respective portion of the liquid-gas mixture onto the linear target in an approximately planar, flat fan spray pattern. A liquid atomizer is coupled in fluid communication between an inlet conduit for the liquid and the mixing chamber for atomizing the liquid discharged into the mixing chamber and creating the liquid-gas mixture.

44 Claims, 4 Drawing Sheets

FLAT FAN SPRAY NOZZLE

FIELD OF THE INVENTION

This invention relates to an atomizing spray nozzle and more particularly to a nozzle having a spray head which produces a flat fan spray pattern of uniform distribution of liquid.

BACKGROUND OF THE INVENTION

Many liquid or gas/liquid spraying devices utilize a nozzle having a spray head which produces a flat fan spray pattern. The most common method to produce such a spray pattern is to dispose an elliptical or rectangular orifice at the tip or discharge end of the spray head, as disclosed in U.S. Pat. No. 5,240,183 ('183 Patent). The drawback of this method is that the spray pattern does not produce a uniform distribution of liquid, especially for two-fluid or gas/liquid spraying devices.

A flat fan spray pattern has also been produced by spray heads having a plurality of circular orifices linearly spaced apart thereon, as disclosed in U.S. Pat. No. 1,485,495 ('495 Patent) and the '183 Patent. The spray head disclosed in the '495 Patent is of rectangular form, while the spray head disclosed in the '183 Patent is cylindrical. To produce the flat fan pattern, each of the orifices is disposed along a given plane and angled outwardly at various angles from the centerline or longitudinal axis of the spray head. It has been found that spray heads such as these tend to produce a nonuniform pattern having areas of high spray density separated by areas of low spray density. Moreover, for a spray head having orifices of a predetermined number and diameter, the greater the angle of the spray emitted from each orifice, as measured from the centerline or spray axis of the spray head, the greater will be the tendency to produce nonuniform spray patterns.

Another drawback of the above-described spray heads for a given orifice diameter, is that the number of spaced linearly aligned orifices disposed on the spray head is limited by the diameter or width of the spray head which, in turn, limits the flow rate of such spray heads which is proportional to the total cross-sectional area of the orifices. In addition, the limited number of orifices would necessitate a greater angle between adjacent orifices for a given spray width thereby producing a nonuniform spray pattern.

A further drawback of the spray head disclosed in the '183 Patent, is that the orifices are disposed at various distances from the longitudinal axis of the mixing chamber. It has been found that in many two-phase systems, such as gas/liquid mixing nozzles, the greatest uniformity of the intermixing of the two phases occurs generally adjacent to the periphery of the mixing chamber whereby the linearly spaced individual orifices do not provide an overall uniform spray pattern.

SUMMARY OF THE INVENTION

Accordingly, it is an object of the present invention to provide a spray head for producing a flat fan spray pattern which overcomes the drawbacks of the prior art.

It is another object to provide a spray head that provides for an arrangement of orifices which results in flat fan spray patterns of greater flow rates and uniformity of the spray pattern.

It is a further object to provide a spray head that substantially equalizes the mass flow ratios of the gas/liquid mixture between the individual orifices and thereby reduces the flow segregation.

According to the present invention, an improved spray head on a nozzle for atomizing a liquid with a gas includes a mixing chamber having a cylindrical inner wall and an outer end wall that has a plurality of orifices arranged circumferentially spaced about the longitudinal axis of the mixing chamber. Each orifice is individually oriented to project a spray jet on a target disposed a predetermined distance from the spray head so as to project a flat fan or approximately planar spray pattern at said target.

The above and other objects and advantages of this invention will become more readily apparent when the following description is read in conjunction with the accompanying drawings.

DETAILED DESCRIPTION OF THE PREFERRED EMBODIMENTS

Figure 1:
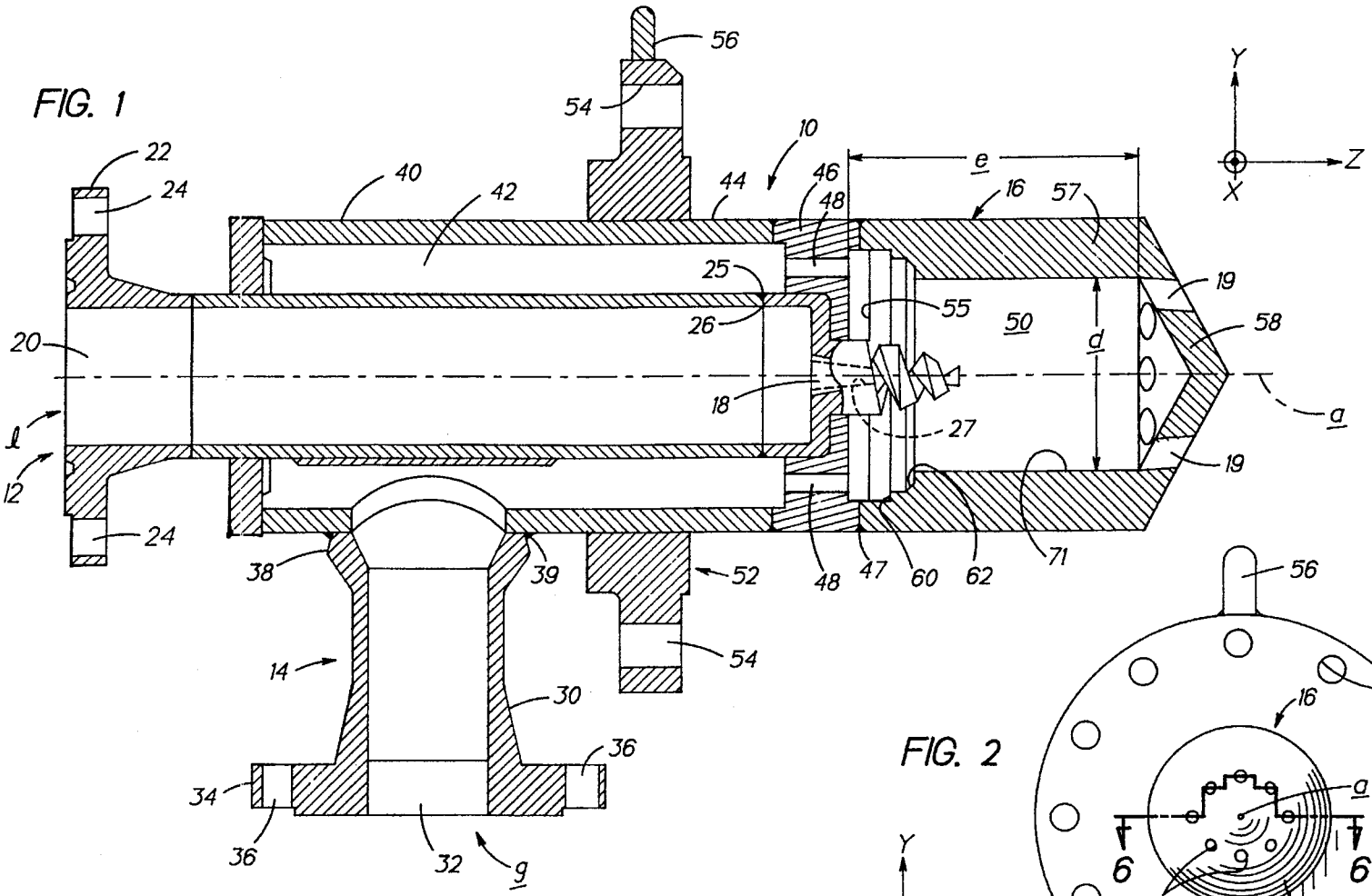
FIG. 1 is a cross-sectional view of a spray nozzle embodying the present invention.
Figure 2:
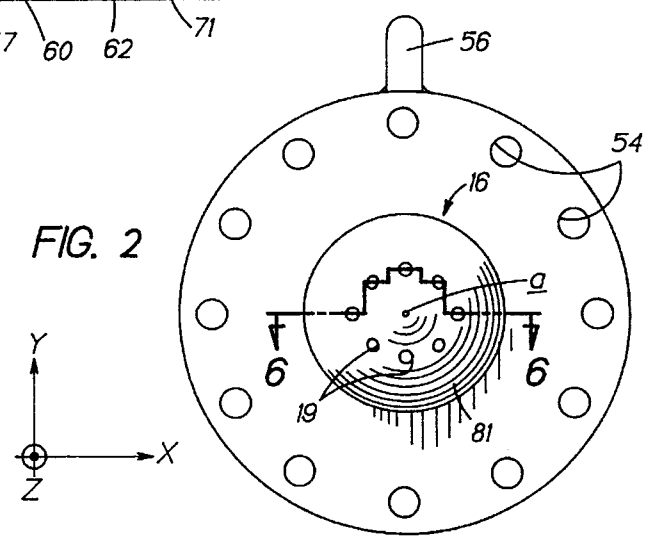
FIG. 2 is a front view of the spray nozzle of FIG. 1.

Depicted in FIG. 1 is a gas/liquid mixing nozzle 10 which is similar to the one disclosed in U.S. Pat. No. 5,240,183 to Bedaw, et at. and assigned to BETE FOG NOZZLE, INC., having a generally cylindrical shaped body and comprising a liquid input conduit 12, a gas input conduit 14, a helical vane or spray member 18 and a spray head 16 coaxially disposed about the helical spray member that controls the spray pattern of the liquid emitted therefrom. As best shown in FIG. 2, a plurality of orifices 19 are disposed in a generally circular pattern about the centerline or longitudinal axis a of the spray head 16. Referring to FIG. 6, each orifice 19 is individually oriented at a predetermined angle so that together the orifices project a flat fan or approximately planar spray pattern along a target 17 at a predetermined distance f from the spray head 16, shown in FIGS. 3 to 5.

The liquid input conduit 12 (FIG. 1) of the nozzle 10 has a longitudinal bore 20 and its outer end 22 is ranged with circumferentially-spaced through bolt holes 24 adapted to be secured to the outer end of a similarly ranged pipe (not shown) for supplying liquid 1 into the bore 20 under a pressure in the range of 3 to 300 psi. The helical member 18 is secured such as by a weld 25 to the inner end 26 of the liquid input conduit 12 to provide for leak-proof liquid flow from the bore 20 into the tapered bore 27 of the helical member 18.

As shown, the gas input conduit 14 comprises an inlet member 30 having an internal bore 32 and a ranged outer end 34 with bore holes 36 circumferentially disposed thereabout. The inner end 38 of the inlet member is perpendicularly secured by a weld 39 to a tubular member 40 of larger inner diameter disposed concentrically about the liquid input conduit 12 to provide an annular passage 42 into which a gas g, such as compressed air, steam or the like, may be supplied under pressure in the range of 3 to 300 psi by any suitable means. The forward or outlet end 44 of the tubular member 40 is secured, as by welding, to a coupling or fitting 46 adapted to fit about the helical member 18. As shown in FIG. 1, fitting 46 has a plurality of circumferentially-spaced passages 48 which are adapted to receive the pressurized gas flowing through the annular chamber 42 of the tubular member 40 and which direct the high velocity gas into a mixing chamber 50 of the spray head 16. It will be recognized that the compressed gas, rather than being fed through a plurality of circumferentially-spaced ports or bores, could be fed through a unitary or plurality of annular slots (not shown) into the spray head 16. The spray head 16 may be secured to the forward end of the fitting 46 by a weld 47.

An annular mounting flange 52 is disposed about the tubular member 40 having circumferentially disposed, a plurality of holes 54 used to mount the nozzle assembly 10. A sighting device or tab 56 (FIGS. 1 and 2) is disposed upon the outer edge of the mounting member 52 to assist with the alignment of the nozzle.

The spray head 16 of generally cylindrical construction provides the chamber 50 for intermixing the liquid and gas phases about the helical member 18. The mixing chamber may be defined by an open inner end 55, a generally cylindrical medial portion 57 and conically tapered or spherically shaped outer end wall portion 58. The spray head 16, at its inner end, includes two (2) annular shoulders 60 and 62 which disrupt the laminar flow of the gas as it enters the chamber 50 from the gas passages 48 whereby the high velocity of gas g becomes turbulent for enhanced mixing with the liquid 1 in the chamber 50 and the atomization of the liquid phase.

The conical outer end wall 58 is provided with a plurality of orifices 19 arranged in circumferentially spaced relationship (FIG. 2) about the longitudinal axis a of the spray head 16. Each of the orifices 19 extends through the outer end wall 58 at a point that is preferably adjacent the inner surface 71 of the medial portion 57 of the mixing chamber 50, as best shown in FIG. 1. It has been found that when the inner ends of the orifices 19 communicate with the outer peripheral portion of the mixing chamber 50, where the intermixing of the liquid and gas phases is at its optimum, that mass flow ratio, defined as the percentage of liquid-to-gas flowing through each orifice, will be equalized to thereby reduce the flow segregation often encountered in two-phase atomizers.

In accordance with this invention, it has been found preferable to employ a greater number of orifices 19 than was heretofore thought feasible and with each of the orifices disposed at a smaller angle with respect to each adjacent orifice than was previously deemed acceptable. Indeed, the desired flow rate of the atomized liquid is proportional to the total cross-sectional area of the orifices. In the past, however, geometrical constraints limited the choices available because of the preferred linear orientation of the orifices, limited in number by the inner diameter d of the spray head 16. One consideration in the determination of the cross-sectional areas or diameters of the orifices 19 is the required exit velocity of the gas/liquid mixture from the spray head 16 which is inversely proportional to the area of the orifices. A practical consideration is that the cross-sectional areas or diameters of the orifices must be sufficient in cross-section to ensure free passage of the liquid and any particulate matter disposed in the liquid to avoid a problem of the orifices being clogged by the particulate matter. Typically, the number of orifices 19 disposed in the outer wall 58 will range between approximately four (4) to twelve (12).

Figure 5:
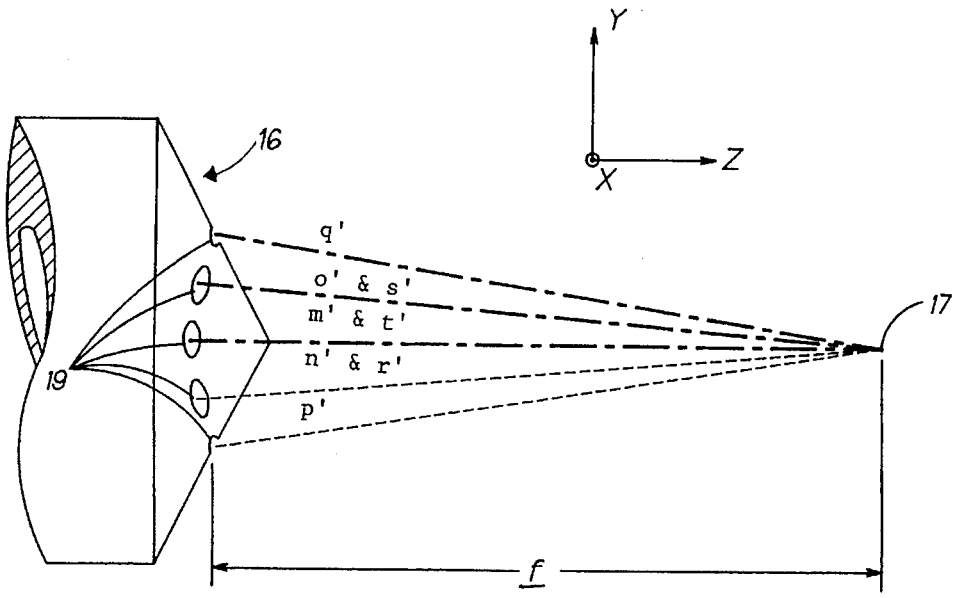
FIG. 5 is a schematic view in the vertical plane (Y-Z) of the nozzle of FIG. 1, which illustrates the trajectory of a spray jet projecting from each orifice onto a target.
Figure 6:
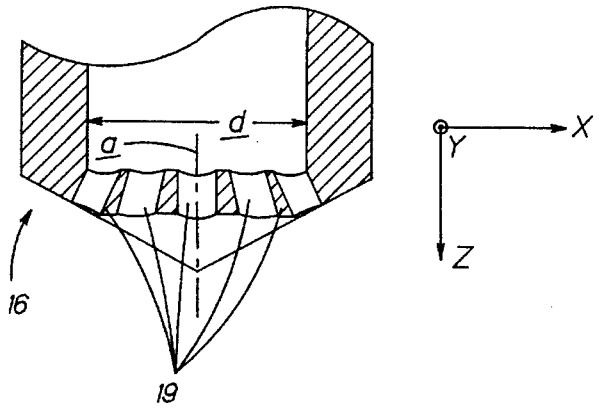
FIG. 6 is a partial cross-sectional view in the horizontal plane (X-Z) of the nozzle taken along line 6—6 of FIG. 2.
Figure 7:
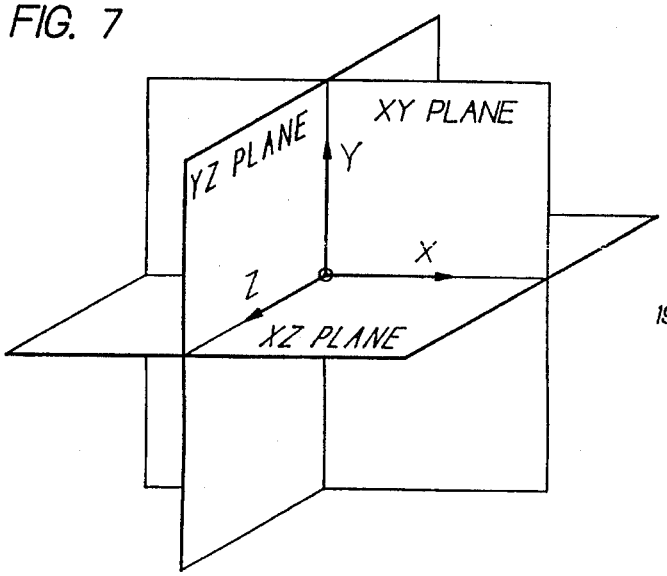
FIG. 7 is a perspective view of three (3) mutually perpendicular planes defined by X, Y and Z axes.

Accompanying FIGS. 1–6 is a spatial reference or coordinate diagram of three (3) mutually perpendicular axes X, Y and Z defining three-dimensional space to assist with the understanding of the interrelation of FIGS. 1–6. Referring to FIG. 7, three (3) mutually perpendicular planes are defined by the X, Y and Z axes such that the X-Y plane (or frontal plane) is defined by the X and Y axes, the X-Z plane (or horizontal plane) is defined by the X and Z axes, and the Y-Z plane (or vertical plane) is defined by the Y and Z axes.

Figure 3:
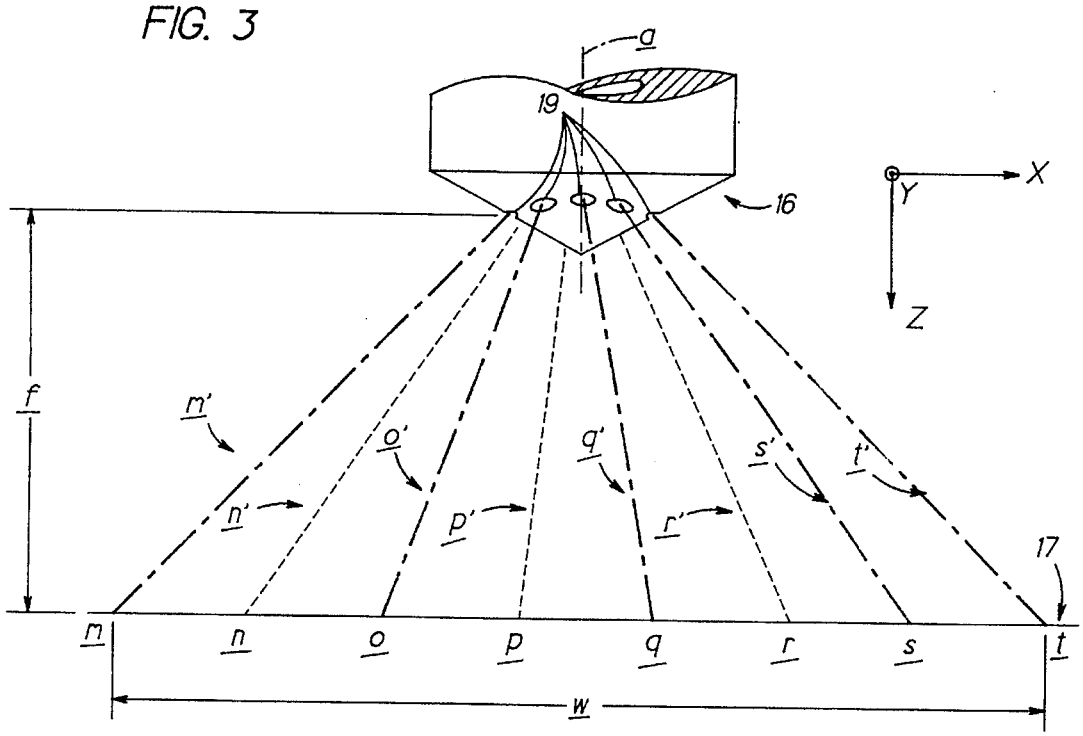
FIG. 3 is a schematic view in the horizontal plane (X-Z) of the nozzle of FIG. 1, which illustrates the trajectory of a spray jet projecting from each orifice onto a target.
Figure 4:
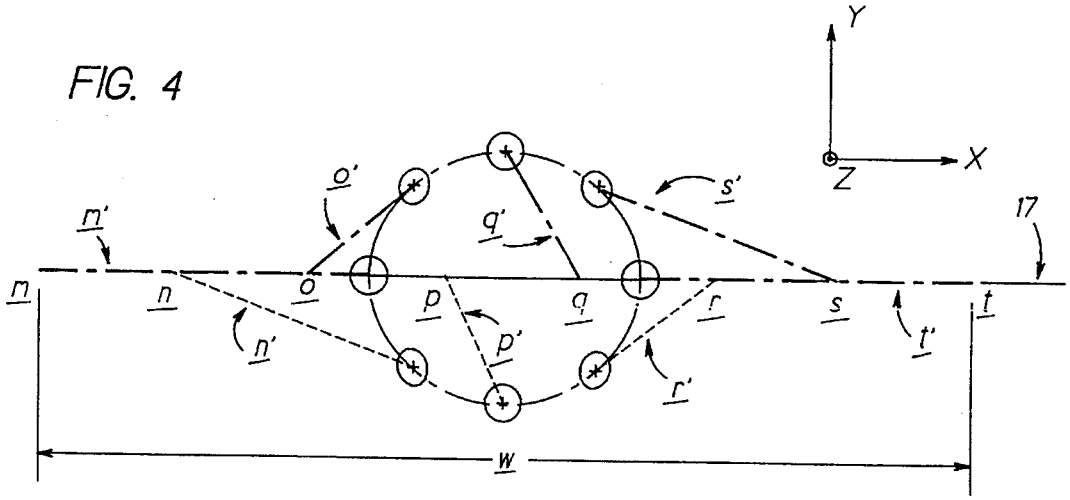
FIG. 4 is a schematic view in the frontal plane (X-Y) of the nozzle of FIG. 1, which illustrates the trajectory of a spray jet projecting from each orifice onto a target.

In the preferred embodiment, illustrated in FIGS. 3–5, the spray head 16 has eight (8) orifices 19 and the target 17 is parallel to the horizontal plane (X-Z) and generally perpendicular to and centered about the longitudinal axis a of the spray head. Each orifice 19 is individually angled such that the spray emanating from the spray head is projected as a flat spray along a line or target 17 at a predetermined distance f forming an approximately planar spray pattern (FIGS. 3 and 5). It should be recognized that the target may be disposed at varying orientations in space by simply modifying the angles of the orifices.

FIGS. 3–5 diagrammatically show the trajectory of the spray jets or projections (m' to t') emanating from each corresponding orifice of the spray head. The spray jets are represented by a centerline or dotted line that corresponds with the longitudinal axis of each orifice. As best shown in FIG. 4, the spray jets (n', p' and r'), which project from the orifices below the target, are represented by a dotted line. Note that the trajectory of the spray jets do not take in consideration the effect of gravity.

In the preferred embodiment, FIG. 3 shows in the horizontal plane X-Z, the trajectory of the spray jets (m' to t') emanating from each corresponding orifice 19 to a corresponding point (m to t) on the target 17. The orifices 19 are angled radially outward from the longitudinal axis a of the cylindrical spray head 16 in the horizontal plane (FIG. 6) to produce a fan pattern of predetermined width w (FIGS. 3 and 4) along the target 17. The angles of the orifices in the horizontal plane (FIG. 6) outwardly increase as the orifices are disposed further from the longitudinal axis a of the spray head 16 to prevent the trajectories of the spray jets from crossing or intersecting each other. The orifices 19 are preferably angled such that the spray jet from each orifice is equispaced along the target 17, as shown in FIG. 3, so as to produce a spray pattern of uniform and evenly distributed material along the target. It should be recognized that the orifices 19 may be angled so that the spray jets intersect the target at varying spacing to provide a spray pattern more concentrated in predetermined areas along the target than others.

To form the flat fan pattern, the orifices 19 (FIG. 1) must also be individually angled in the vertical plane Y-Z such that the spray jets (m' to t') converge upon the target 17, as illustrated in FIG. 5. The angle of convergence of each orifice is dependent upon the distance f of the target from the spray head and the disposition of the orifice on the spray head. In the preferred embodiment, as depicted in FIG. 5, spray jets m' and t' project in the same horizontal plane (X-Z) as the target. The angle of the trajectory of spray jets o' and s', in the vertical plane (Y-Z), are equal, but opposite to the angle of spray jets n' and r'. The angle of the trajectory of spray jets p' and q', in the vertical plane (Y-Z) are equal, but opposite to each other, and greater than the angle of spray jets o', s', n', and r'.

A schematic view of the spray head in the frontal plane X-Y is shown in FIG. 4 which simultaneously illustrates both the angle of divergence and angle of convergence of each spray jet (m' to t'), shown in FIGS. 3 and 5 respectively. Each orifice 19 is preferably angled such that the jets of the orifices disposed above the target (jets o', q', and s') and the jets of the orifices disposed below the target (jets n', p', and r') alternately project along the target to provide for symmetry about the longitudinal axis a of the spray head 16.

Figure 8:
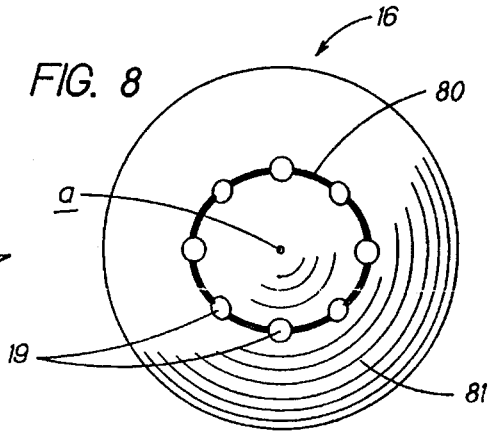
FIG. 8 is a front elevational view of an alternative embodiment of the present invention having a V-shaped groove interconnecting the orifices.

In an alternative embodiment illustrated in FIG. 8, the orifices 19 are interconnected by a U-shaped or V-shaped groove or channel 80 that is inscribed on an outer surface 81 of the spray head 16. The width of the channel is preferably between 0.3 and 0.6 times the width or diameter of the orifice and the depth thereof may be between 0.15 and 0.5 times the width or diameter of the orifice. The angle of the walls of the V-shaped channel 80 is preferably between 60° and 90°. The channel is centered about the longitudinal axis of each orifice 19 and opens generally parallel to the longitudinal axis a of the spray head 16.

The channel 80 widens the outer edge of the orifices 19 such that the spray jets (m' to t'), as shown in FIG. 3, emanating therefrom peripherally expand along the channel upon exiting each orifice to thereby produce a broader orifice jet pattern being less concentrated than one emanating from an orifice. The expanded spray jet spans a greater area along the target 17 to produce a more uniform spray distribution.

It will be recognized by those skilled in the art that one or more of the orifices, illustrated as being circular in the drawings, could be changed to include various noncircular cross-sections, such as elliptical, rectangular, or square.

For proper operation of the nozzle 10, it is important that the inner diameter d, as shown in FIG. 1, of the cylindrical portion 57 of the spray head 16 be substantially greater than the maximum outer diameter of the helical member 18. It has also been found that the ratio of the length e of the spray head, as shown in FIG. 1, to the inner diameter d of the spray head should be approximately 1.5 to 1.7.

As liquid 1 under pressure is fed through the longitudinal bore 20 of the tube 12 and flows into the tapered bore 27 of the helical element 18 where the liquid is deflected outwardly by the upstream surfaces of the helical member into a thin conical sheet. Simultaneously, compressed gas g being supplied into annular passage 42 and which flows though bores 48, will enter the mixing chamber 50 and at high velocity and in a turbulent state, impacts with the liquid.

In the mixing chamber 50, the turbulent and high velocity expanding gas g emanating from the holes 48 intersects the thin conical sheet of liquid l emitted from the surfaces of the helical member 18. This action causes the liquid to be atomized by and mixed with the expanding gas. As the liquid/gas mixture is impelled through the chamber 50, further mixing and atomization occurs as it advances toward the orifices 19. The pressurized gas/liquid mixture rapidly expands as it exits the orifices 19 to ambient or atmospheric pressure to cause further atomization of the mixture.

It has been found that this nozzle construction will produce very fine liquid sprays in which the average droplet size may vary, depending on the flow ratio from 10 microns to 500 microns.

Figure 9:
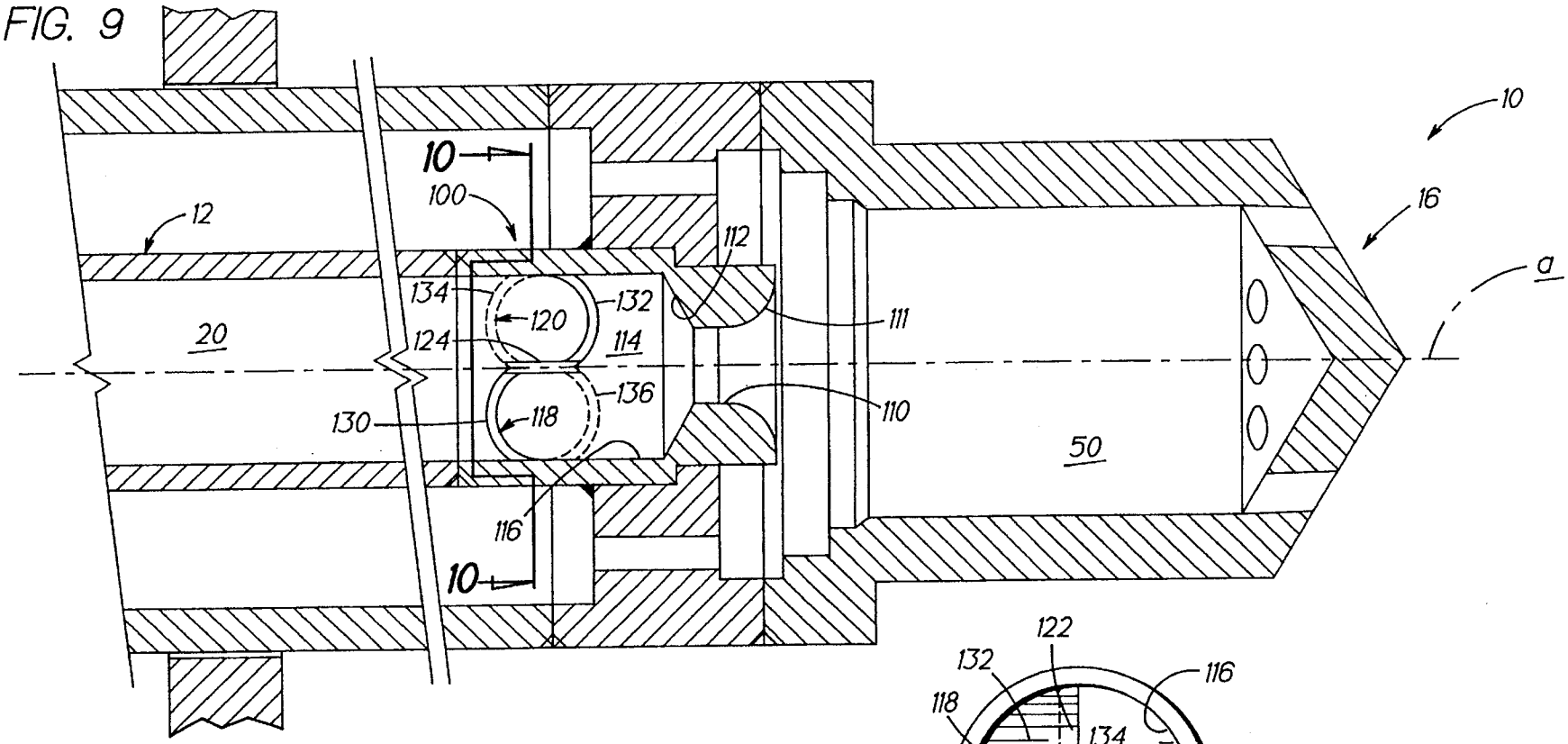
FIG. 9 is a cross-sectional view of an alternative embodiment of the present invention.

In an alternative embodiment shown in FIG. 9, a sinusoidal spray member 100 of the type similar to the spray nozzle disclosed in U.S. Pat. No. 4,014,470 to Burnham and assigned to BETE FOG NOZZLE, INC., may be used in lieu of the helical spray member 18. The sinusoidal spray member 100 may be a tubular unitary body similar to the liquid input conduit 12 having an outlet end with a central outlet orifice 110 of cylindrical configuration which extends through the outer end wall 111 thereof and intersects with conical surface 112, which constitutes the outlet wall of an outlet chamber 114. The outer end wall 111 radially flares from the longitudinal axis a of the spray head 16 to expand the liquid spray pattern about the mixing chamber 50 of the spray head 16. The outlet chamber 114 is also defined by the inner diameter or cylindrical bore 116 of the spray member 100.

Swirl imparting means are provided by transversely extending segmental vanes 118 and 120 which separate the outlet chamber 114 from cylindrical bore 20 of the liquid input conduit 12.

Figure 10:
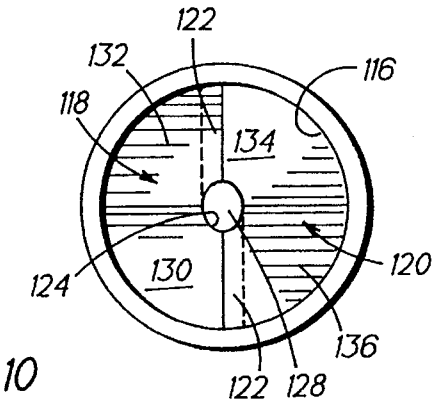
FIG. 10 is a cross-sectional view of the alternative embodiment taken along line 10—10 of FIG. 9.

As shown in FIG. 9, vanes 118 and 120 comprise two generally semi-circular segments, when viewed in the direction of fluid flow through the nozzle 10. It will be noted that the two sinusoidal vanes 118 and 120 are juxtaposed in edge-to-edge relation defining a figure "8" which extends horizontally across the bore 20 of the nozzle 10. As shown at 122 (FIG. 10), the vanes overlap circumferentially to some extent on diametrically opposite sides of the opening 128 to ensure against direct axial flow of the annular portion of the flow pattern. Each vane 118 and 120 has an identical arcuate recess 124 (FIG. 9), provided along its inner edge, by which the generally elliptical central opening 128 is formed.

Viewed in the direction of fluid flow (FIG. 9), semicircular vane 118 has a convex lobe 130, in one quadrant of the passage facing upstream and a concave lobe 132 in the adjacent quadrant. Similarly, vane 120 has a convex lobe 134 in a quadrant of the passage diametrically opposite convex lobe 130 of the vane 118 and a concave lobe 136 in a quadrant diametrically opposite concave lobe 132 of the vane 118. The vanes are thus approximately sinusoidal and, as best shown in FIG. 9, the cylindrically curved lobe portions of each of the sinusoidal vanes 118 and 120 are interconnected by axially extending leg portions which cross at about the center of the bore 20 and being recessed as at 124 to form the central flow opening 128.

A liquid or liquid slurry under pressure, such as waterborne particulates, may be supplied to the sinusoidal spray member 100 via the liquid input conduit 12 of the nozzle 10. Within the inlet chamber 122, the slurry moves within the confines of the bore 20 as a column or single stream until contacting the vanes 118 and 120 where the liquid column is separated into two (2) streams or portions. One stream is annular, the other axial. A swirling movement is imparted to the outer peripheral or annular stream of the slurry as it passes over the surface of the vanes 118 and 120, while the central portion of the slurry passes more or less directly through the central opening 128 formed by the vanes. In the outlet chamber 114, the vortical stream caused by the vanes 118 and 120 and the axially moving stream reunite and mix together, thereby providing for uniform particulate dispersion in the liquid phase in the mixing chamber 50 of the spray head 16. In addition, this mixing is enhanced by the dimensional relationship of the central outlet orifice 110 to the much larger cross sectional diameter of the outlet chamber 114 and conical upper surface 112.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described our invention, what is claimed is:

1. An improved spray head of a nozzle for mixing a liquid with a gas comprising an inner end receiving the gas and liquid, a medial portion having an inner surface forming a mixing chamber for mixing the gas and liquid, and an outer end wall having a plurality of orifices in fluid communication with the mixing chamber and angularly spaced relative to each other about an axis of the mixing chamber for projecting a spray of the liquid-gas mixture, wherein substantially all of the orifices each have a flow axis oriented at a predetermined angle to said mixing chamber axis and directed toward a target for atomizing and directing the liquid-gas mixture in a spray pattern flowing in a direction across the target, and wherein the target is substantially disposed in a plane extending in the flow direction of the spray pattern.

2. An improved spray head of a nozzle, as set forth in claim 1, and wherein the orifices are adjacent said inner surface of the medial portion thereof.

3. An improved spray head of a nozzle, as set forth in claim 2, and wherein the medial portion of said mixing chamber has a cylindrical inner surface.

4. An improved spray head of a nozzle, as set forth in claim 1, and wherein the orifices are angled so that the spray projecting from each orifice is equi-spaced along the target.

5. An improved spray head of a nozzle for mixing a liquid with a gas comprising an open inner end to receive the gas and liquid, a medial portion having an inner surface forming a mixing chamber, and an outer end wall having a plurality of orifices coupled in florid communication with the mixing chamber and arranged in an approximately circumferential-spaced relation about an axis of the mixing chamber, each orifice having an axis oriented at a predetermined angle to the mixing chamber axis so that the orifices project an approximately planar spray on a target disposed a predetermined distance from each orifice, and wherein the orifices are angled so that the sprays projecting from the orifices are substantially equi-spaced along said target and the spray projecting from each orifice disposed above said target alternately intersect said target with the spray projecting from each orifice disposed below said target.

6. An improved spray head of a nozzle, as set forth in claim 5, and wherein the orifices are equi-spaced about the longitudinal axis of said mixing chamber.

7. A improved spray head of a nozzle, as set forth in claim 1, and wherein the outer end wall is conical shaped.

8. An improved spray head of a nozzle, as set forth in claim 1 which further comprises a groove disposed on an outer surface of said outer end wall to interconnect said orifices.

9. An improved spray head of a nozzle, as set forth in claim 8, and wherein the groove is V-shaped.

10. An improved spray head of a nozzle, as set forth in claim 8, and wherein the groove is U-shaped.

11. A nozzle for mixing a liquid with a gas, comprising a flow passage for the liquid apart from the gas, a liquid atomizer coupled in fluid communication with a downstream end of the liquid flow passage for atomizing the liquid apart from the gas, a flow passage for the gas separate from the liquid flow passage, and a spray head comprising a medial portion having an inner surface forming a mixing chamber, said mixing chamber being coupled in fluid communication with said liquid atomizer and said gas flow passage for receiving atomized liquid and gas and forming a liquid-gas mixture, and an outer end wall having a plurality of orifices in fluid communication with the mixing chamber and angularly spaced relative to each other about an axis of the mixing chamber for projecting a spray of the liquid-gas mixture, wherein approximately all of said plurality of orifices each have a flow axis oriented at a predetermined angle to said mixing chamber axis and directed toward a target for further atomizing and directing the liquid-gas mixture in a spray pattern flowing in a direction across the target, and wherein the target is approximately disposed within a plane extending in a flow direction of the spray pattern.

12. A nozzle for mixing a liquid with a gas, as set forth in claim 11, and wherein the liquid atomizer includes a spray member helically extended outwardly of said liquid flow passage and having at least one-turn of predetermined outermost diameter.

13. A nozzle for mixing a liquid with a gas, as set forth in claim 11, and wherein the liquid atomizer comprises a fluid conduit having an outlet orifice, vane means within said conduit for imparting a vortical component of motion to liquid flowing therethrough, said vane means having an opening therethrough which is substantially smaller than the outlet orifice and is in axial alignment therewith, said vane means including approximately sinusoidal portions spanning adjacent semi-circular segments of the conduit, each sinusoidal portion including convex and concave lobes interconnected by an axially extending leg portion, said convex lobes being disposed toward the inlet end of the conduit and the concave lobes being offset axially from the convex lobes, said convex and concave lobes being in alternate circumferential sequence in said conduit.

14. A nozzle for mixing a liquid with a gas, comprising:

at least one inlet conduit for introducing the liquid and gas into the nozzle;

a mixing chamber coupled in fluid communication with the at least one inlet conduit for receiving and mixing the liquid and gas; and means coupled in fluid communication with the mixing chamber for atomizing a plurality of spray jets of the liquid-gas mixture angularly spaced relative to each other about an axis of the mixing chamber, and for directing approximately all of the plurality of spray jets to converge in a spray pattern toward a target, wherein the spray pattern extends in a flow direction across the target and the target is substantially located within a plane extending in the flow direction of the spray pattern.

15. A nozzle as defined in claim 14, including two inlet conduits, a first inlet conduit for receiving the liquid, and a second inlet conduit for receiving the gas separate from the first inlet conduit and coupled in fluid communication with the mixing chamber for discharging the gas into the mixing chamber, and further including a liquid atomizer coupled in fluid communication between the first inlet conduit and the mixing chamber for atomizing the liquid flowing through the first conduit and discharging the atomized liquid into the mixing chamber.

16. A nozzle as defined in claim 14, further including a liquid atomizer coupled in fluid communication between the at least one inlet conduit and the mixing chamber for atomizing the liquid flowing through the at least one inlet conduit and discharging the atomized liquid into the mixing chamber.

17. A nozzle as defined in claim 16, wherein the liquid atomizer includes at least one vane extending transversely relative to an elongated axis of the inlet conduit for receiving fluid from the inlet conduit and creating a swirling annular flow, and defining at least a portion of an aperture in an approximately central portion thereof for receiving fluid from the inlet conduit and creating a substantially axial flow.

18. A nozzle as defined in claim 16, wherein the mixing chamber is defined by a substantially cylindrical surface extending between the liquid atomizer and the means for atomizing a plurality of spray jets, and the ratio of the length of the mixing chamber to its diameter is within the range of approximately 1.5 to 2.0.

19. A nozzle as defined in claim 14, wherein the means for atomizing a plurality of spray jets includes a plurality of orifices angularly spaced relative to each other about an axis of the mixing chamber within an end portion of the nozzle and coupled in fluid communication with the mixing chamber, each orifice defining a flow axis directed toward the target for atomizing and directing a respective spray jet of the liquid-gas mixture onto the target.

20. A nozzle as defined in claim 17, wherein the at least one vane defines a substantially convex lobe and a substantially concave lobe.

21. A nozzle as defined in claim 20, wherein each lobe is approximately semi-circular.

22. A nozzle as defined in claim 20, wherein the convex lobe is located upstream of the concave lobe.

23. A nozzle as defined in claim 17, comprising two vanes, wherein each vane extends transversely through a respective substantially semi-circular portion of the inlet conduit.

24. A nozzle as defined in claim 16, wherein the liquid atomizer includes an approximately helical surface extending in the direction from the downstream end of the inlet conduit toward the mixing chamber for atomizing the liquid discharged from the conduit into the mixing chamber.

25. A nozzle as defined in claim 14, wherein each spray jet is coupled in fluid communication with the mixing chamber adjacent to a surface defining the mixing chamber for receiving peripheral fluid flow from the chamber.

26. A nozzle as defined in claim 14, wherein the spray jets are circumferentially spaced about the axis of the mixing chamber.

27. A nozzle as defined in claim 14, wherein the spray jets are substantially equally spaced along the target.

28. A nozzle as defined in claim 14, wherein the axis of the mixing chamber is disposed substantially within the plane of the target.

29. A nozzle as defined in claim 14, wherein a plurality of spray jets emanate above the target and a plurality of spray jets emanate below the target, and the spray jets emanating above the target alternately intersect the target with the spray jets emanating below the target.

30. A nozzle as defined in claim 14, wherein the spray jets emanate from the nozzle at locations substantially equally spaced relative to each other about the axis of the mixing chamber.

31. A nozzle for mixing a liquid with a gas, comprising:

a first inlet conduit for receiving the liquid;

a second inlet conduit for receiving the gas separate from the first inlet conduit;

a liquid atomizer coupled in fluid communication with a downstream end of the first inlet conduit for atomizing the liquid flowing through the conduit and discharging the liquid separate from the gas;

a mixing chamber coupled in fluid communication with the liquid atomizer and the second inlet conduit for mixing the gas and atomized liquid into a liquid-gas mixture; and an end portion defining a plurality of apertures in fluid communication with the mixing chamber and angularly spaced relative to each other about an axis of the mixing chamber for creating a spray of the liquid-gas mixture, wherein approximately all of the apertures each define a flow axis directed toward a target for atomizing and directing the liquid-gas mixture in a spray pattern flowing in a direction across the target, and the target is substantially located within a plane extending in the flow direction of the spray pattern.

32. A nozzle as defined in claim 31, wherein each of the plurality of apertures is spaced adjacent to a surface defining the mixing chamber for receiving peripheral fluid flow from the mixing chamber.

33. A nozzle as defined in claim 31, wherein the plurality of apertures are formed in an approximately circumferential-spaced relation about the axis of the mixing chamber.

34. A nozzle as defined in claim 33, wherein the upstream ends of the apertures define a substantially circular pattern.

35. A nozzle as defined in claim 31, wherein the axis of the mixing chamber is disposed substantially within the plane of the target.

36. A nozzle as defined in claim 31, wherein each aperture is defined by a substantially cylindrical surface within the end portion of the nozzle.

37. A nozzle as defined in claim 31, wherein the apertures are angled relative to each other such that their sprays are substantially equally spaced along the target.

38. A nozzle as defined in claim 31, wherein the apertures are angularly spaced relative to each other so that a plurality of apertures are disposed above the target and a plurality of apertures are disposed below the target, and the spray from each aperture disposed above the target alternately intersect the target with the spray from each aperture disposed below the target.

39. A nozzle as defined in claim 31, wherein the apertures are substantially equally spaced relative to each other about a longitudinal axis of the mixing chamber.

40. A nozzle as defined in claim 31, wherein the target extends along an approximately straight line disposed within said plane for forming an approximately planar spray pattern.

41. A nozzle as defined in claim 31, wherein the liquid atomizer includes means for creating a swirling peripheral flow of liquid and means for creating an axial flow of liquid within the peripheral flow of liquid.

42. A nozzle as defined in claim 41, wherein the means for creating a swirling peripheral flow includes at least one vane extending transversely relative to an elongated axis of the nozzle, and defining a substantially convex lobe and a substantially concave lobe.

43. A nozzle as defined in claim 42, wherein the means for creating an axial flow includes an aperture formed at least in part by an approximately central portion of the at least one vane.

44. A nozzle as defined in claim 42, comprising two vanes, each vane transversely extending through a respective substantially semi-circular portion of the nozzle.

* * * * *